US007004179B1

(12) United States Patent
Lunde

(10) Patent No.: US 7,004,179 B1
(45) Date of Patent: Feb. 28, 2006

(54) HAIR STYLING ARTICLE

(76) Inventor: Sandra Lunde, 2720 Ubben Ave., Ellsworth, IA (US) 50075

( * ) Notice: Subject to any disclaimer, the term of this patent is extended or adjusted under 35 U.S.C. 154(b) by 91 days.

(21) Appl. No.: 10/427,253

(22) Filed: May 1, 2003

(51) Int. Cl.
*A45D 8/04* (2006.01)

(52) U.S. Cl. ..... 132/273

(58) Field of Classification Search ..... 132/273, 132/275, 200, 54, 280–284, 101, 107, 274; 2/174; D28/39–43; 24/30.5 S, 7, 115 N, 24/129 R See application file for complete search history.

(56) References Cited

U.S. PATENT DOCUMENTS 566,779 A * 9/1896 Leibreich ..... 132/106
731,575 A * 6/1903 Johnston ..... 132/106
2,329,821 A * 9/1943 Bregou ..... 132/273
2,796,069 A * 6/1957 Mooney, Jr. ..... 132/273
2,832,358 A * 4/1958 Chambers ..... 132/273
3,669,130 A 6/1972 Petroczky
5,566,690 A * 10/1996 Shih-Ming ..... 132/276
6,135,125 A 10/2000 Sartena
D442,335 S 5/2001 Sartena
6,601,590 B1 * 8/2003 Neary ..... 132/275

* cited by examiner

*Primary Examiner*—John J. Wilson
*Assistant Examiner*—Robyn Doan
(74) *Attorney, Agent, or Firm*—McKee, Voorhees & Sease, P.L.C.

(57) ABSTRACT

A hair styling article for providing increased volume to a switch of hair is provided. The hair styling article includes a base and a plurality of arcuate-shaped members extending from the base. In operation, the switch of hair is held in place by the hair styling article in a flared-out fashion which increases hair volume. The invention also includes a method of using the hair styling article.

16 Claims, 3 Drawing Sheets

HAIR STYLING ARTICLE

BACKGROUND OF THE INVENTION

1. Field of the Invention

The present invention relates to hair styling accessories. More particularly, though not exclusively, the present invention relates to a hair styling article for use in adding volume to a switch of hair.

2. Problems in the Art

It is a well-known hair styling technique to band a portion of hair together, forming ponytails, pigtails and the like. Depending upon the natural body and volume of the hair, the hair will take a variety of forms. Although a matter of personal preference, it is often preferred that the hair extending from the base of the ponytail give the appearance of having good hair volume. Hair styling products, such as hair sprays and hair gels, have been used for this purpose. They suffer from several deficiencies. Such products are limited in their ability to add volume to the hair. They also must be reapplied to maintain hair in the same style. Other attempts have been made to improve volume using combs, clips and similar articles. As yet, such attempts have proved unsuccessful and suffer from various deficiencies.

Accordingly, a primary objective of the present invention is the provision of a hair styling article that styles and provides volume to a switch of hair in ponytails and the like.

A still further objective of the present invention is a hair styling article that is easy to use and allows the hair stylist to style a switch of hair.

Another objective of the present invention is the provision of a hair styling article that is hidden from normal view when in use, so as not to detract from the aesthetics of the hair style.

A still further objective of the present invention is the provision of a hair styling article that is economical to manufacture and durable in use.

These and other objectives become apparent from the following description of the invention.

SUMMARY OF THE INVENTION

The present invention relates to a new hair styling article that helps add volume to the switch of hair, such as the hair used to form a ponytail. The hair styling article of the present invention generally includes a round base and a plurality of arcuate-shaped members extending from the base. The arcuate-shaped members are adapted to secure the hair styling article to the switch of hair while holding at least a portion of the hair in a "fanned-out" or generally radial position about the periphery of the base.

The present invention also relates to a new method for adding volume to a switch of hair. This new method generally comprises providing a hair styling article as described previously, selecting a switch of hair to style, banding the switch of hair to form a base, positioning the hair styling article near the base of the hair, and then styling the hair such that a portion of the switch of hair is held in a flared-out fashion about the periphery of the base and another portion of the hair is disposed through the center opening of the base. Those skilled in the art will appreciate that the present invention greatly increases the volume of the switch of hair or ponytail. The hair also surrounds the hair styling article such that the hair styling article is generally hidden from normal view.

BRIEF DESCRIPTION OF THE DRAWINGS

The present invention is illustrated by way of example and not limitation in the figures of the accompanying drawings, and in which.

DETAILED DESCRIPTION OF THE PREFERRED EMBODIMENT

The present invention will be described as it applies to its preferred embodiment. It is not intended that the present invention be limited to the described embodiment. It is intended that the present invention cover all modifications and alternatives which may be included within the spirit and scope of the invention.

Figure 1:
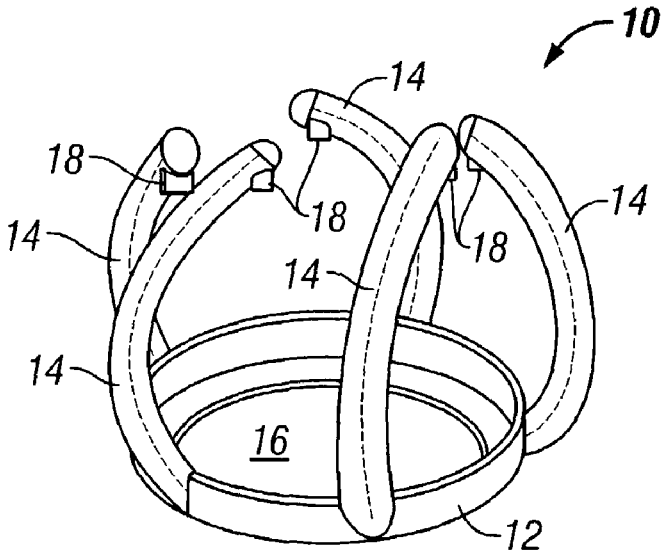
FIG. 1 is a perspective view of a preferred embodiment of the hair styling article of the present invention.

Now referring to the drawings, the preferred hair styling article of the present invention is shown in FIG. 1. The hair styling article 10 includes a round or circular base 12 and a plurality of arcuate-shaped members 14 extending from the periphery of the base. The base preferably includes an aperture that forms a center opening 16. As described later, the center opening 16 allows a portion of hair to pass through the base 12.

In its preferred form, the base 12 and arcuate-shaped members 14 are integrally formed of plastic in an injection molding process. The plastic arcuate-shaped members 14 are flexible, which makes it easier to position the hair styling article 10 in a switch of hair. Other materials and manufacturing processes can be used to form the hair styling article 10 without departing from the scope of the invention.

Figure 2:
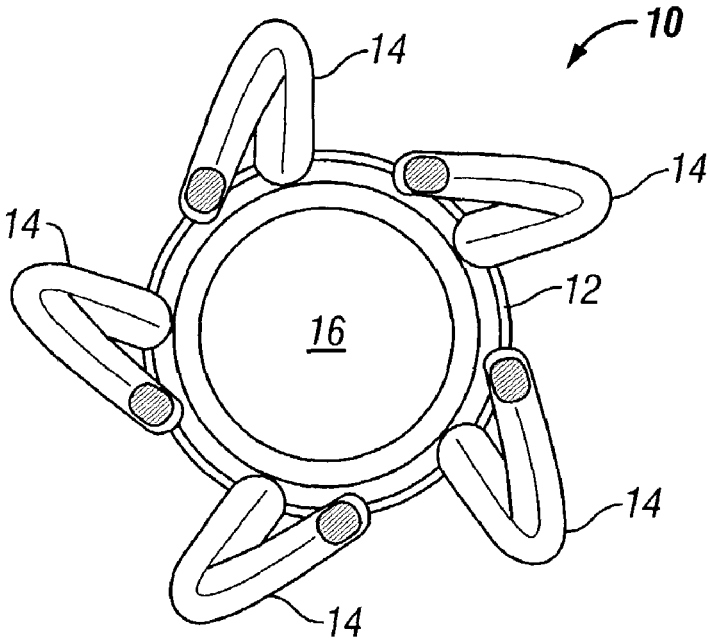
FIG. 2 is a top view of the hair styling article of FIG. 1.

As illustrated in FIG. 2, the arcuate-shaped members 14 are spaced apart along the periphery of the base 12. The body portion of each of the arcuate-shaped members 14 generally defines a plane. The arcuate-shaped members 14 extend from the base 12 in the same general direction. However, the arcuate-shaped members 14 are generally offset such that the plane defined by a particular member does not intersect the center of the base 12. This configuration of the arcuate-shaped members has been found desirable, as it makes the hair easier to style and helps maintain a portion of a switch of hair in a "flared out" fashion wherein the hair extends in a generally radial manner around the periphery of the base 12.

Each of the arcuate shaped members 14 includes a first end at the base 12 and a second end opposite the first end. A hair retaining portion 18 is disposed near the second end of the arcuate-shaped member. The hair retaining portion 18 helps the hair styling article 10 grasp or grip a portion of the switch of hair and hold the hairstyling article 10 in place.

Figure 3:
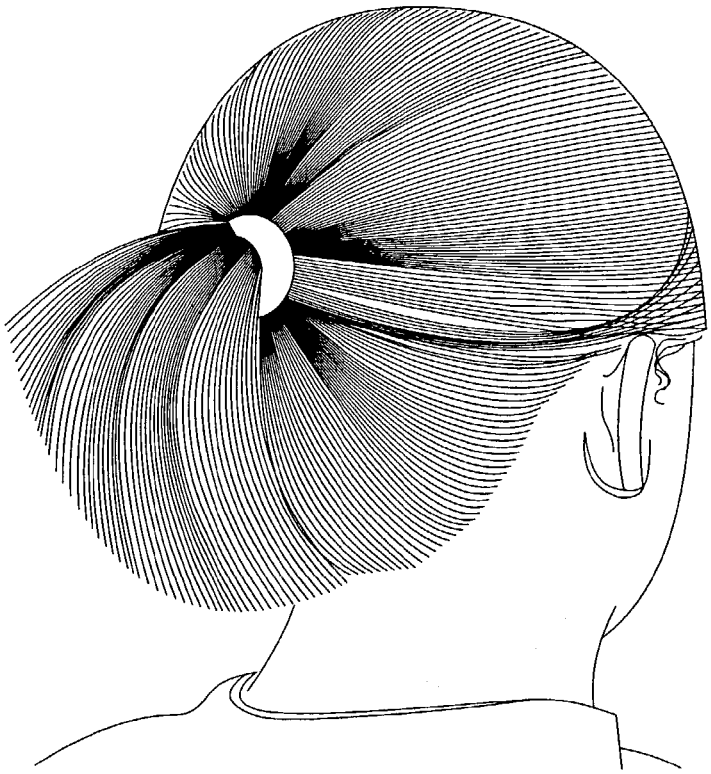
FIG. 3 is a pictorial showing a switch of hair.
Figure 4:
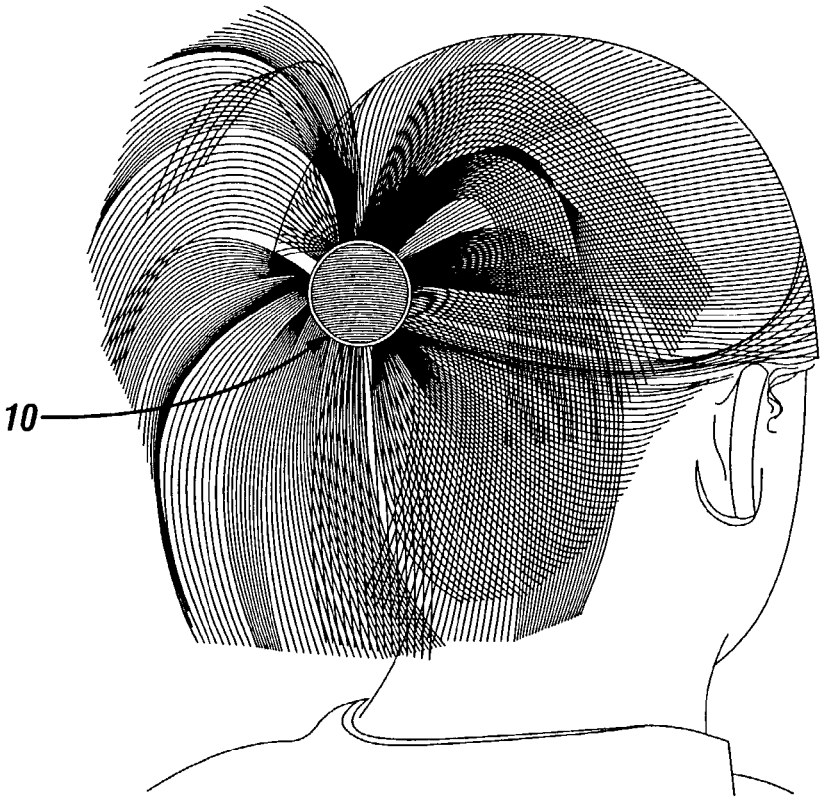
FIG. 4 is a pictorial showing the hair styling article of FIG. 1 positioned near the base of a switch of hair.
Figure 5:
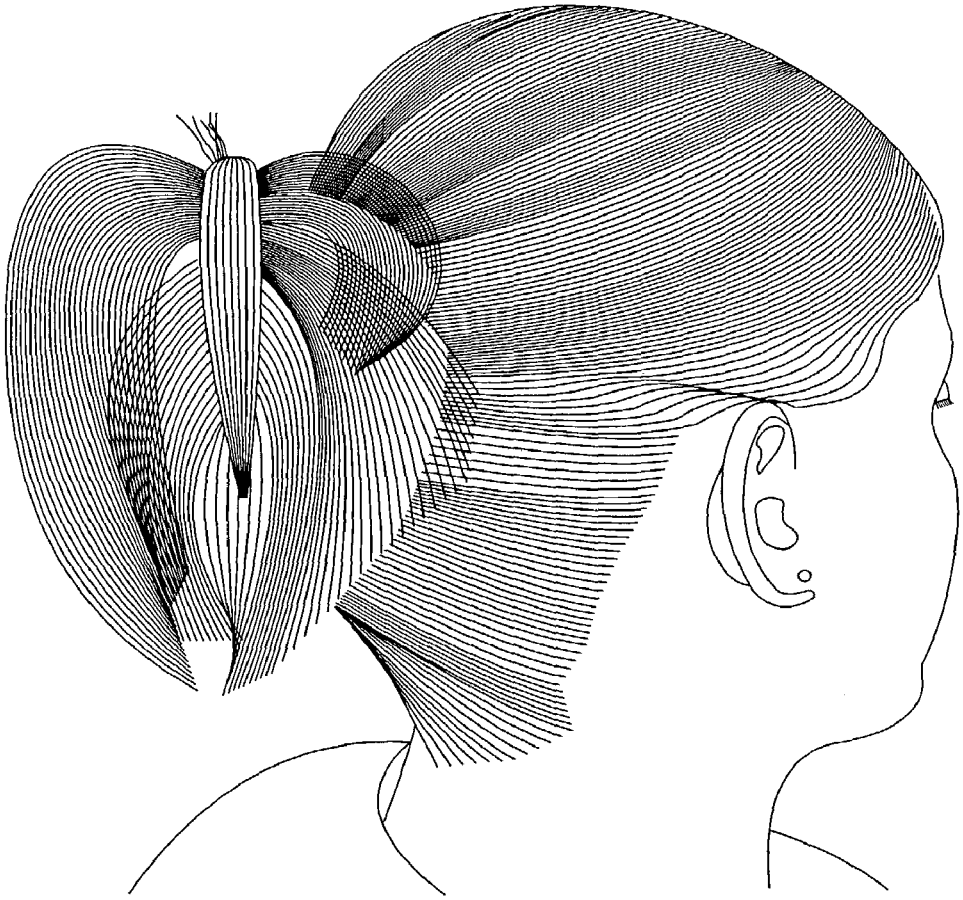
FIG. 5 is a pictorial showing a switch of hair styled by the hair styling article of FIG. 1.

The hair styling article 10 is easy to use. The preferred use of the hair styling article 10 is with ponytails, pigtails and the like. However, its use is not so limited. Respecting use of the hair styling article with a ponytail, first a switch of hair is selected and banned together to form a ponytail. As those skilled in the art will appreciate, the ponytail 18 has a base portion adjacent the material or device that bands the hair together near the user's scalp (see FIG. 3). The hair styling article 10 is positioned in the hair near the base portion of the ponytail 18 with the arcuate-shaped members 14 extending toward the base of the ponytail 18 (see FIG. 4). It is preferred that the hair near the base of the ponytail 18 is bunched up or flattened so that at least a portion of the hair extends laterally in a generally radial fashion before the hair styling article 10 is put into the hair. Next, the stylist styles the switch of hair such that a portion of the switch of hair extends around the periphery of the base 12 between the arcuate-shaped members 14 (see FIG. 5). Another portion of the switch of hair is pulled through the center opening 16. The hair styling article holds the switch of hair as shown in FIG. 5, which greatly improves the volume of the switch of hair, giving the appearance that the hair has good body. Those skilled in the art will appreciate that use of the hair styling article in this way will produce a variety of different hair styles depending on the type of hair and how the hair is positioned relative the hair styling article 10.

A general description of the present invention as well as a preferred embodiment of the present invention has been set forth above. Those skilled in the art to which the present invention pertains will recognize and be able to practice additional variations in the structure and methods described which fall under the teachings of this invention. Accordingly, all such modifications and additions are deemed to be within the scope of the invention, which is to be limited only by the claims appended hereto.

What is claimed is:

1. A new hair styling article that adds volume to a switch of hair held in place by a hair retaining portion, the hair styling article comprising:

a substantially round base with an opening through a middle portion of the base; and a plurality of arcuate-shaped members extending upwardly and outwardly from the base, the members curving back inwardly toward an area above the opening with a hair retaining portion at an end of the members;

said arcuate-shaped members adapted to fan out hair and to secure the hair styling article to the switch of hair while holding at least a portion of the hair in a generally radial position about the periphery of the base.

2. The hair styling article of claim 1 wherein the base has an aperture forming an open center, the aperture adapted to allow a portion of the switch of hair to pass through the base.

3. The hair styling article of claim 2 wherein the arcuate-shaped members are spaced apart near the periphery of the base.

4. The hair styling article of claim 3 wherein the arcuate-shaped members are flexible.

5. The hair styling article of claim 3 wherein each of the arcuate-shaped members generally defines a plane and the arcuate-shaped members are offset about the periphery of the base such that the defined planes do not intersect the center of the base.

6. The hair styling article of claim 4 wherein the arcuate-shaped members are plastic.

7. The hair styling article of claim 1 wherein the base and arcuate-shaped members are integrally formed.

8. The hair styling article of claim 1 wherein each of the arcuate-shaped members having a first end proximate the base and a second end extending therefrom, the arcuate-shaped member including a hair retaining portion near the second end for use in securing the hair styling article to the switch of hair.

9. A new method of adding volume to a switch of hair when styling the hair, the method comprising:

providing a hair styling article having a substantially round base with a center opening and a plurality of arcuate-shaped members extending from the periphery of the base, the arcuate-shaped members having a first end proximate the base and a second end extending therefrom said plurality of arcuate-shaped members extending, the arcuate-shaped member including a hair retaining portion near the second end that aids in securing the hair styling article to the switch of hair;

selecting a switch of hair to style;

banding the switch of hair to form a base;

positioning the hair styling article near the base; and styling the hair such that a portion of the switch of hair is held in a flared-out fashion around the periphery of the base and another portion of the hair is disposed through the center opening.

10. The method of claim 9 wherein the base and the arcuate-shaped members of the hair styling article are integrally formed.

11. The method of claim 9 wherein each of the arcuate-shaped members generally defines a plane and the arcuate-shaped members are offset about the periphery of the base such that the defined planes do not intersect the center of the base.

12. A new hair styling article that adds volume to a switch of hair, the hair styling article comprising:

a substantially round base having a periphery;

a plurality of arcuate-shaped members having a first end proximate the base and a second end extending therefrom; and said plurality of arcuate-shaped members extending upwardly and outwardly from the base, the members curving back inwardly toward an area above the base the arcuate-shaped members including a hair retaining portion near the second end that aids in securing the hair styling article to the switch of hair.

13. The hair styling article of claim 12 wherein the arcuate-shaped members are spaced apart near the periphery of the base.

14. The hair styling article of claim 12 wherein the arcuate-shaped members are integrally formed.

15. The hair styling article of claim 12 wherein each of the arcuate-shaped members generally defines a plane and the arcuate-shaped members are offset about the periphery of the base such that the defined planes do not intersect the center of the base.

16. A new hair styling article that adds volume to a switch of hair held in place by a hair retaining portion, the hair styling article comprising:

a substantially round base; and a plurality of arcuate-shaped members extending from the base that are hidden when rotated into position;

said arcuate-shaped members adapted to fan out hair and to secure the hair styling article to the switch of hair while holding at least a portion of the hair in a generally radial position about the periphery of the base;

wherein the arcuate-shaped members are spaced apart near the periphery of the base, each of the arcuate-shaped members generally defines a plane and the arcuate-shaped members are offset about the periphery of the base such that the defined planes do not intersect the center of the base; and wherein each of the arcuate-shaped members having first end proximate base and a second end extending therefrom, said arcuate-shaped members including a means for retaining hair said plurality of arcuate-shaped members extending upwardly and outwardly from the base, the members curving back inwardly toward an area above the base.

* * * * *

UNITED STATES PATENT AND TRADEMARK OFFICE

CERTIFICATE OF CORRECTION

PATENT NO. : 7,004,179 B1
DATED : February 28, 2006
INVENTOR(S) : Lunde, Sandra

It is certified that error appears in the above-identified patent and that said Letters Patent is hereby corrected as shown below:

Column 4,
Line 3, after "extending" insert -- upwardly and outwardly from the base, the members curving back inwardly toward an area above the opening -- before ", the arcuate-shaped member including a hair".

Signed and Sealed this

Sixth Day of June, 2006

JON W. DUDAS
*Director of the United States Patent and Trademark Office*